US005377574A

United States Patent [19]

Lempke

[11] Patent Number: 5,377,574

[45] Date of Patent: Jan. 3, 1995

[54] METALLIC VOICING ELEMENT FOR MOUTH ORGANS

[76] Inventor: Michael C. Lempke, 1117 W. Kilgore Rd., Portage, Mich. 49008

[21] Appl. No.: 25,929

[22] Filed: Mar. 3, 1993

Related U.S. Application Data

[63] Continuation-in-part of Ser. No. 901,129, Jun. 19, 1992, abandoned.

[51] Int. Cl.[6] ..... G10D 7/12

[52] U.S. Cl. ..... 84/377; 156/644; 156/664

[58] Field of Search ..... 84/377, 375, 380 A, 84/383 A; 156/644, 664

[56] References Cited

U.S. PATENT DOCUMENTS

| | | | |
|---|---|---|---|
| 417,069 | 12/1889 | Morgan et al. . | |
| 2,407,312 | 9/1946 | Magnus | 84/377 |
| 2,416,451 | 2/1947 | Magnus | 18/42 |
| 2,473,210 | 6/1949 | Magnus | 84/377 |
| 2,718,808 | 9/1955 | Magnus | 84/377 |
| 2,745,307 | 5/1956 | Elsasser | 84/377 |
| 3,015,980 | 1/1962 | Hohner | 84/377 |
| 3,710,275 | 1/1973 | Tanaka et al. | 84/409 X |
| 4,406,206 | 9/1983 | Huang | 84/377 |
| 4,502,362 | 3/1985 | Zacharias | 84/377 |
| 4,704,938 | 10/1987 | Zacharias | 84/377 |
| 5,228,468 | 7/1993 | Kapadia | 137/1 |

*Primary Examiner*—Michael L. Gellner
*Assistant Examiner*—Patrick J. Stanzione
*Attorney, Agent, or Firm*—Flynn, Thiel, Boutell & Tanis

[57] ABSTRACT

A mouth organ includes a voicing element which is a metal plate having in one surface a plurality of U-shaped recesses extending slightly more than halfway through the thickness of the plate, and having in an opposite surface a plurality of rectangular recesses which are each aligned with a respective U-shaped recess and which each extend slightly more than halfway through the thickness of the plate. Each pair of corresponding U-shaped and rectangular recesses communicate at their inner ends and define a respective elongate reed which is an integral portion of the plate and is secured at only one end to the plate. All of the recesses are can be formed simultaneously through photochemical machining. In a variation, each reed has a plurality of recesses spaced along its length which increase progressively in size, to simulate a tapered characteristic for the reed.

18 Claims, 2 Drawing Sheets

23
17
24
10
12
27
14
16
21
11
18
22
37
38
2B
2B
16
34
27
33
39
31
14
32

16
14
46
16
28
14

39
41
31
34
33
16
27
14
28
48
46

METALLIC VOICING ELEMENT FOR MOUTH ORGANS

This application is a continuation-in-part of U.S. Ser. No. 07/901 129 filed Jun. 19, 1992, now abandoned.

FIELD OF THE INVENTION

The present invention relates to mouth organs or harmonicas and, more specifically, to improved voicing elements for mouth organs.

BACKGROUND OF THE INVENTION

Mouth organs include, in their simplest construction, a body with air-slots, which is typically made of plastic. Metallic voice plates, which have a plurality of voice reeds secured thereto, are affixed to both the upper and lower sides of the body. One of the voice plates includes the pressure reeds, while the other includes the suction reeds. The voice reeds must be tuned at least once. The sides of the voice plates which face away from the air-slot defining body are protected by a cover shell, typically made of thin sheet metal.

The above-described prior art mouth organ requires, a large number of manufacturing steps for each component and, in addition, considerable labor to assemble the instrument from the finished parts. There is a long-standing need for a mouth organ which is less expensive to manufacture than prior-art instruments of similar and which in particular requires less labor for both its manufacture and assembly.

Efforts to satisfy this long-standing need have been directed toward integration of the voice reeds and voice plate into a single entity. These efforts have not yet produced a high-quality, commercially viable solution, for some of the following reasons:

A. In the case of plastic voicing elements, the nonlinear elastic properties of many plastics alter the tonal qualities of the instrument. As a note becomes louder or softer, it may also become sharper or flatter. Serious musicians, accustomed to metallic reeds, find these characteristics undesirable.

B. Tooling, whether it is in the form of stamping dies or in the form of injection molds, requires a relatively large initial investment in terms of time and money. This fact slows the product development cycle, particularly for small manufacturers.

C. Flash (in the case of injection moldings and castings) and burrs (in the case of stampings) are undesirable physical results of the respective processes. The removal of flash or burrs requires some form of secondary labor, which is contrary to the need for reduced labor.

Accordingly, an object of the invention is to provide an improved voicing element for a mouth organ which is inexpensive, which can be manufactured and assembled with minimal labor, and which has accurate pitch and tonal qualities under normal conditions of use, including different sound volumes.

A further object is to provide such a voicing element which is made from a conventional linear-elastic metal.

A further object is to provide such a voicing element which can be manufactured with a minimal tooling cost.

A further object is to provide such a voicing element which can be manufactured so as to maintain a high degree of dimensional control without requiring any subsequent effort to effect flash removal, burr removal, tuning, or the like.

SUMMARY OF THE INVENTION

The objects and purposes of the invention, including those set forth above, are met according to one form of the invention by providing a method of fabricating a voicing element with a sound-producing reed by carrying out the step of chemical etching an approximately U-shaped recess into a platelike element from a surface on one side thereof so as to leave an elongate portion of the element which is integrally coupled at only one end to a remaining portion of the element and which serves as the reed.

A different form of the invention involves a method of fabricating a voicing element with a reed, including the step of simultaneously removing material from opposite sides of a platelike element to form respective recesses on opposite sides thereof which are of approximately equal depth, which communicate with each other at inner ends thereof, and which define an elongate portion of the element integrally coupled at only one end to a remainder of the element, the elongate portion serving as the reed.

A different form of the invention involves a voicing element which includes a platelike element having first and second recesses in opposite sides thereof which are of approximately equal depth and which communicate at inner ends thereof, the recesses defining an elongate integral portion of the element which is coupled at only one end to a remaining portion of the element and which serves as a sound-producing reed.

Yet another form of the invention relates to a platelike element having a recess and having an integral elongate portion which projects into the recess and which is coupled to a remaining portion of the element at only one end thereof, the elongate portion having a plurality of recesses therein at spaced locations therealong, and serving as a sound-producing reed.

BRIEF DESCRIPTION OF THE DRAWINGS

Preferred embodiments of the invention are described in detail below with reference to the accompanying drawings, in which.

DETAILED DESCRIPTION

Figures 1, 2A, 2B, 2C, 3:
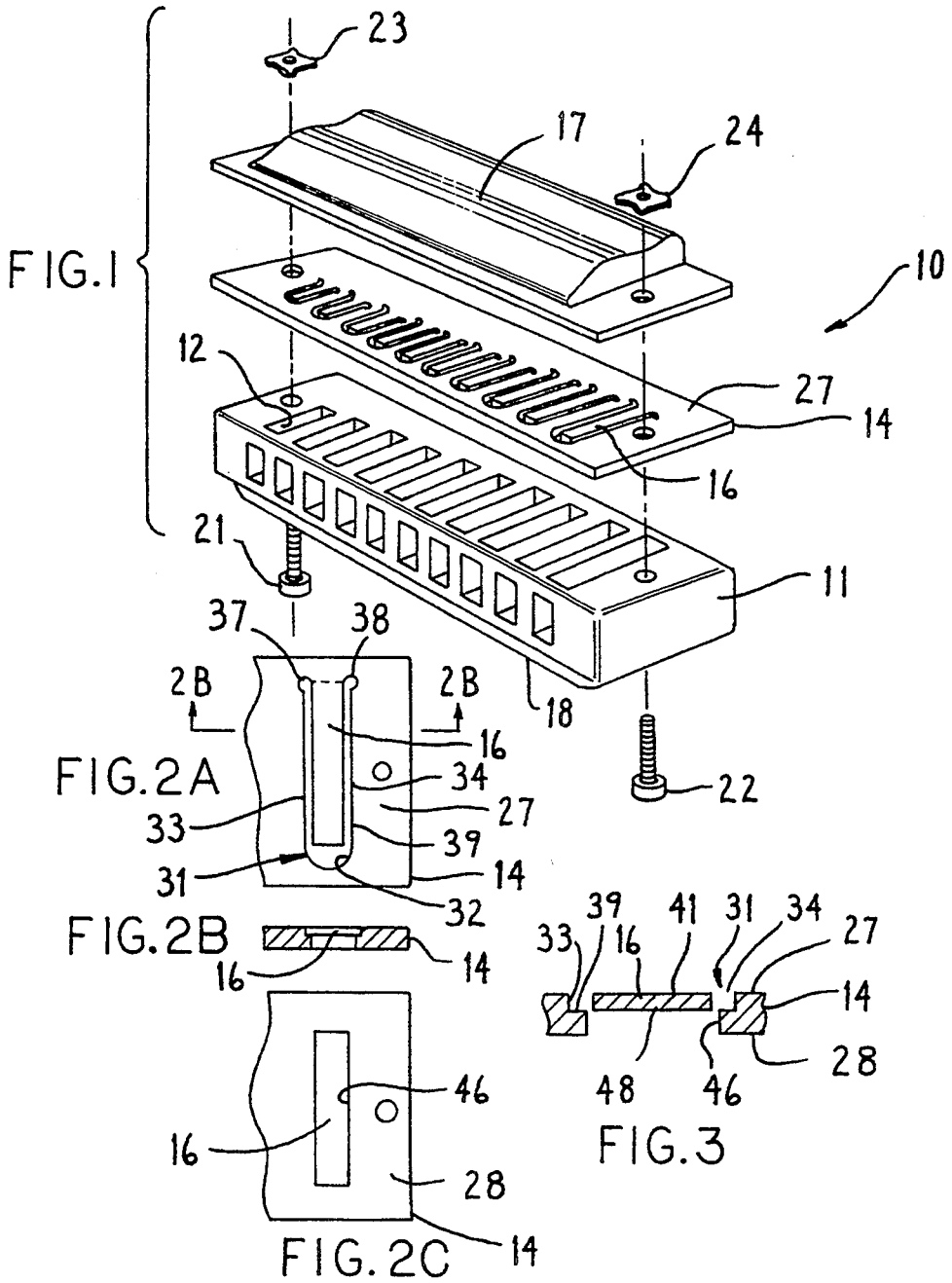
FIG. 1 is an exploded perspective view of a mouth organ having a voicing element which embodies the present invention.
FIG. 2A is a fragmentary top view of part of the voicing element of FIG. 1.
FIG. 2B is a fragmentary sectional view of the voicing element, taken along the line 2B—2B in FIG. 2A.
FIG. 2C is a fragmentary bottom view of part of the voicing element of FIG. 1.
FIG. 3 is a sectional view similar to FIG. 2B, but in an enlarged scale.

FIG. 1 is an exploded view of a mouth organ 10 which embodies the present invention. The mouth organ includes a body 11 having a plurality of spaced and separate air slots therein which each open through a side surface, a top surface, and a bottom surface of the body 11. A platelike upper voicing element 14, which has a plurality of reeds 16, is disposed on the upper surface of the body 11 so that each reed is disposed over and is aligned with a respective air slot 12. A lower voicing element, which is effectively identical to the upper voicing element but which is not visible in the drawings, is disposed against the bottom surface of the body 11.

Metal cover shells 17 and 18 are respectively disposed above and below the upper voicing element 14 and the not-illustrated lower voicing element. Screws 21 and 22 extend through aligned openings in the bottom shell 18, lower voicing element, body 11, upper voicing element 14, and top shell 17, and engage respective nuts 23 and 24 in order to secure the illustrated elements together.

The body 11 and the shells 17 and 18 are conventional and not a part of the present invention, and are therefore not described in further detail. The reeds 16 of the upper voicing element 14 are suction reeds, whereas the reeds of the not-illustrated lower voicing element are pressure reeds. Those skilled in the art will recognize that, aside from slight differences in the sizes of the reeds in order to obtain different pitches, the upper and lower voicing elements are effectively identical. The subject matter of the present invention can be fully understood from a description of the upper voicing element 14, and therefore only the upper voicing element 14 is described in detail.

Referring to FIGS. 2A–2C and 3, the upper voicing element 14 is a metal plate having a top surface 27 and a bottom surface 28. To define each reed 16, the plate has in the top surface 27 a recess 31, which is an approximately U-shaped or Ω-shaped recess 31 having a bight portion 32 of semicircular shape, having leg portions 33 and 34 which project outwardly from opposite ends of the bight substantially parallel to each other, and having circular portions 37 and 38 at the outer ends of the leg portions 33 and 34, the circular portions 37 and 38 each having a diameter which is greater than the width of the legs 33 and 34 of the recess 31. The portion of the metal plate between the legs 33 and 34 of the recess 31 serves as the reed 16, the top surface 41 of the reed 16 being flush with and being a portion of the top surface 27 of the metal plate. The inner end or bottom of the recess D1 is defined by a planar U-shaped or Ω-shaped surface 39 on the metal plate.

In addition, for each reed 16, a rectangular recess 46 is provided in the bottom surface 28 of the metal plate, the recess 46 being disposed below and being aligned with the rectangular reed 16, but being slightly wider than and slightly longer than the reed 16. The inner end of the recess 46 is the bottom surface 48 of the reed 16.

Referring to FIG. 3, the depth of the recess 46 (the distance from surface 28 to surface 48) is substantially equal to the depth of the recess 31 (the distance from the surface 27 to the surface 39). The depth of each of the recesses 46 and 31 is slightly greater than half the thickness of the metal plate which is the voicing element 14, as a result of which the recesses communicate at their inner ends along a narrow U-shaped slot which outlines the periphery of three sides of the reed 16.

According to the invention, the recesses 31 and 46 in the voicing element 14 are simultaneously formed by an etching technique, in particular by applying to the top and bottom surfaces 27 and 28 of the metal plate respective not-illustrated masks which each have several openings corresponding in shape to the respective recesses which are to be formed, and by then dipping or spraying the plate in a conventional chemical etching solution which chemically etches or erodes the non-masked portions to produce the recesses. Since the etching or erosion occurs at substantially the same rate on each side of the plate, the recesses 31 and 46 which are etched into the surfaces 27 and 28 end up with substantially equal depths, as mentioned above. The etching technique is itself conventional, and is therefore not described in further detail here.

When the etching process is completed, the resulting voicing element 14 is immersed in a suitable rinse in order to neutralize or remove the chemical solution which effected the etching, at which point the voicing element 14 is substantially completed. There is no need to remove burrs or flash. Also, if the masks have been accurately designed and applied, and if the concentration of the chemical solution used for etching and the time in which the voicing element 14 is exposed to the solution are accurately controlled, there should be little or no need to manually alter the reeds 16 of the voicing element through bending or material removal in order to tune the reeds.

Figure 4:
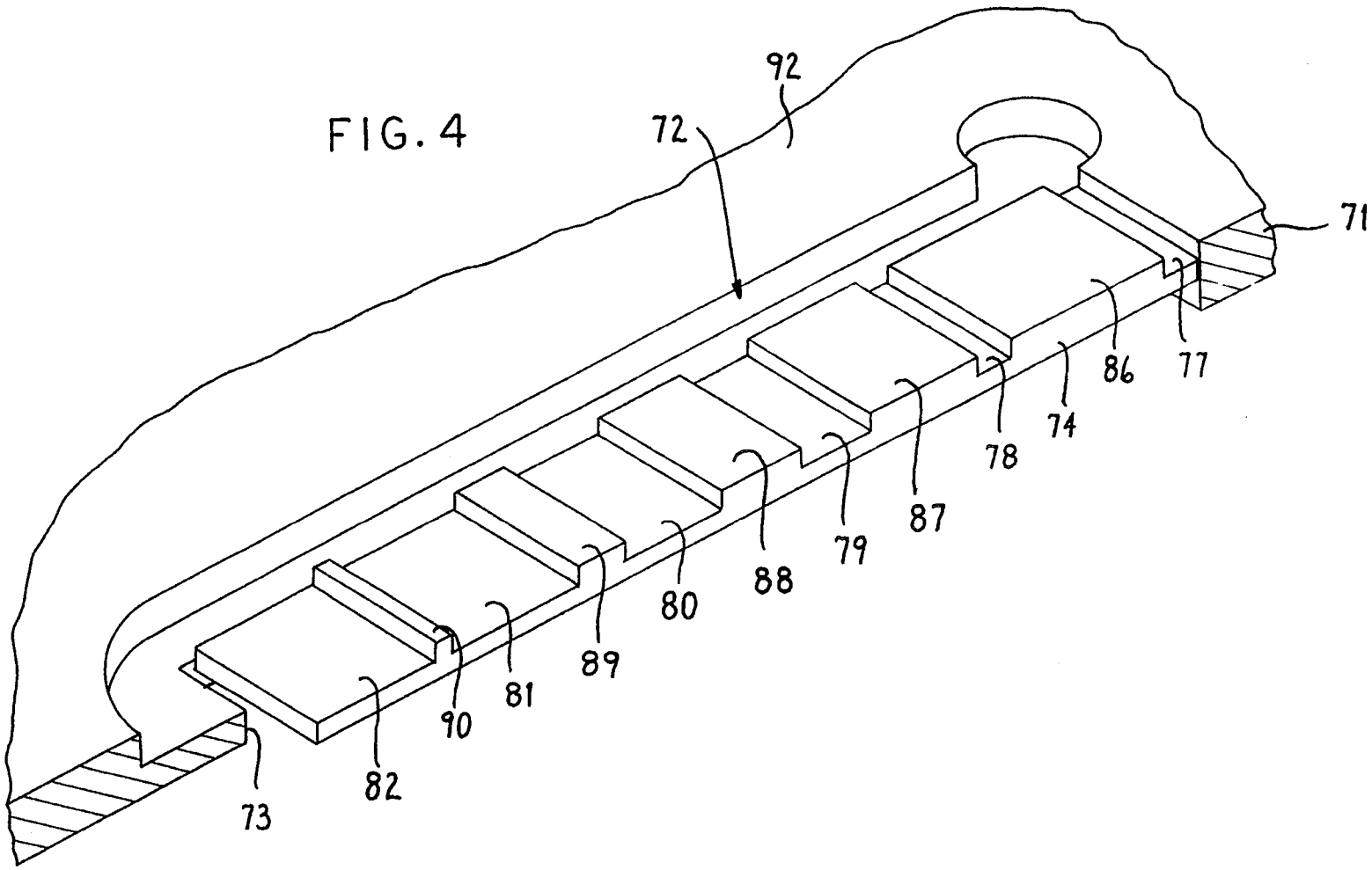
FIG. 4 is a fragmentary perspective view of part of a voicing element which is an alternative embodiment of the voicing element of FIGS. 1–3.

FIG. 4 depicts a voicing element 71 which is an alternative embodiment of the voicing element 14 of FIGS. 1–3. The voicing element 71 is intended to decrease the effort required to play high notes, by increasing the surface area of the reed. While the surface area could be increased by increasing the reed width, this also increases the torsional rigidity and makes it more difficult to "bend" the pitch (or in other words to pull the pitch downwardly with increased air pressure while playing the mouth organ). Tapering the thickness of the reed along its length provides the desired effect, but an object of the invention is to achieve the effect of a taper in a manner which permits the reed to be fabricated by chemical machining rather than by mechanical grinding. The voicing element 71 of FIG. 4 achieves this result.

More specifically, the voicing element 71 has in its top and bottom surfaces respective recesses 72 and 73 which are effectively identical to the recesses 31 and 46 in FIGS. 2–3, and has a rectangular reed 74 which is similar to the reed 16 of FIGS. 2 and 3, except as follows. The reed 74 has in its upper surface a plurality of transversely extending recesses or grooves 77–82 of rectangular cross section, which are created by chemical etching. The recesses 77–82 have equal depths, and in particular each have a depth which is approximately one-quarter to three-quarters of the depth of the recess 72 in the top of the plate. The widths of the grooves or recesses 77–82 increase progressively from the recess 77 to the recess 82.

As a result of the presence of the recesses 77–82, the reed 74 has several separate transversely extending upward projections 86–90 at spaced locations along its length, each of which is disposed between a respective adjacent pair of the recesses 77–82. The transversely extending projections 86–90 have respective widths which decrease progressively from the projection 86 to the projection 90. The upper ends of the projections 86–90 have planar surfaces which are each flush with the top surface 92 of the voicing element 71.

The recesses 77–82 and the projections 86–90 approximate a progressive taper of the thickness of the reed 74 along its length. The preferred taper characteristic is an exponential taper, but it will be that, by appropriately selecting the widths of the recesses and projections in the reed, the simulated taper may alternatively approximate a linear taper or some other taper characteristic. Although FIG. 4 shows the recesses 77–82 in the top surface of the reed 74, it will be recognized that some or all could alternatively be provided in the bottom surface thereof.

Those skilled in the art will recognize that the present invention satisfies the long-standing need for a mouth organ which requires less labor for the manufacture and assembly of its parts. Although the preferred embodiment of the invention relies upon photochemical machining for its manufacture, it will be recognized that other methods of material removal may be employed.

Although two preferred embodiments of the inventive voicing element have been illustrated and described in detail, it will be recognized that there are variations or modifications of these elements, including the rearrangement of parts, which lie within the scope of the present invention.

The embodiments of the invention in which an exclusive property or privilege is claimed are defined as follows:

1. A method of fabricating a voicing element having a sound-producing reed, comprising the steps of chemically etching an approximately U-shaped recess into a platelike element from a surface on one side thereof and simultaneously chemically etching a further recess of approximately rectangular shape into said voicing element from a further surface disposed on an opposite side thereof from said surface having said U-shaped recess, said recesses having substantially equal depths and being in communication with each other at inner ends thereof so as to leave an elongate portion of said element which is integrally coupled at only one end to a remaining portion of said element and which serves as the reed, said elongate portion having a thickness at said one end thereof which is substantially less than a thickness of said platelike element at a location adjacent said one end of said elongate portion.

2. A method according to claim 1, wherein said approximately U-shaped recess has a bight portion of approximately semicircular shape, has two leg portions which extend outwardly from opposite ends of said bight portion approximately parallel to each other, and has at an outer end of each said leg portion a circular portion, said circular portions each having a diameter greater than a transverse width of said leg portions.

3. A method according to claim 1, wherein said approximately U-shaped recess and said rectangular recess each have a depth which is slightly greater than half the thickness of said platelike element.

4. A method according to claim 1, including the step of etching a plurality of recesses into said projection at spaced locations along the length thereof, said recesses having sizes which progressively increase along the length thereof.

5. A method according to claim 4, wherein said step of etching said recesses into said projection includes the step of forming said recesses as grooves of substantially rectangular cross-section which extend transversely across said projection.

6. A method of fabricating a voicing element having a reed, comprising the steps of:

removing material from opposite sides of a platelike element to form respective recesses on opposite sides thereof which are of different shade, which communicate with each other at inner ends thereof, and which define an elongate portion of said element integrally coupled at only one end to a remainder of said element, said elongate portion serving as said reed.

7. A method according to claim 6, wherein said removing step includes the steps of applying respective masks to opposite sides of said platelike element, and then exposing said platelike element to a fluid which simultaneously chemically etches said element on opposite sides thereof, said recesses being of approximately equal depth.

8. A method according to claim 6, wherein one of said recesses is approximately U-shaped and the other thereof is approximately rectangular, said approximately U-shaped recess and said approximately rectangular each having a depth which is slightly greater than half the thickness of said platelike element.

9. A method according to claim 8, wherein said approximately U-shaped recess has a bight portion of approximately semicircular shape, has two leg portions which extend outwardly from opposite ends of said bight portion approximately parallel to each other, and has at an outer end of each said leg portion a circular portion, said circular portions each having a diameter greater than a transverse width of said leg portions.

10. A method according to claim 6, including the step of removing material from said elongate portion to form a plurality of recesses therein at spaced locations along the length thereof, said recesses in said elongate portion having sizes which progressively increase along the length thereof.

11. A voicing element, comprising: a platelike element having first and second recesses in opposite sides thereof which are of different shape and which communicate at inner ends thereof, said recesses defining an elongate integral portion of said element which is coupled at only one end to a remaining portion of said element and which serves as a sound-producing reed.

12. An apparatus according to claim 11, wherein said first and second recesses are of approximately equal depth; and wherein said first recess is approximately U-shaped, and said second recess is approximately rectangular.

13. An apparatus according to claim 12, wherein said U-shaped recess has a bight portion of approximately semicircular shape, has two leg portions projecting outwardly from opposite ends of said bight portion substantially parallel to each other, and has respective circular portions each disposed at the outer end of a respective said leg portion and each having a diameter greater than a width of said leg portions, said elongate portion being approximately rectangular and being disposed between said leg portions of said U-shaped recess, and said rectangular recess of being aligned with and having a width slightly greater than the width of said elongate portion.

14. An apparatus according to claim 11, wherein said elongate portion has a plurality of recesses therein at spaced locations therealong, said recesses in said elongate portion increasing progressively in size from one end thereof toward the other end thereof.

15. An apparatus according to claim 14, wherein each of said recesses in said elongate portion is a transversely extending groove of approximately rectangular cross-section.

16. An apparatus comprising: A platelike element having means defining a recess therein and having an integral elongate portion which projects into said recess and which is coupled to a remaining portion of said element only at one end thereof, said elongate portion having a plurality of recesses therein at spaced locations therealong, and serving as a sound-producing reed.

17. An apparatus according to claim 16, wherein said recesses in said elongate portion increase progressively in size from one end thereof toward the other end thereof.

18. An apparatus according to claim 16, wherein said recesses in said portion are approximately transversely extending grooves of generally rectangular cross-section.

* * * * *

UNITED STATES PATENT AND TRADEMARK OFFICE

CERTIFICATE OF CORRECTION

PATENT NO. : 5 377 574

DATED : January 3, 1995

INVENTOR(S) : Michael C. LEMPKE

It is certified that error appears in the above-indentified patent and that said Letters Patent is hereby corrected as shown below:

Column 5, line 63; change "shade" to ---shape---.

Column 6, line 12; before "each" insert ---recess---.

Column 6, line 50; change "recess of being: to ---recess being---.

Signed and Sealed this

Twenty-fifth Day of April, 1995

Bruce Lehman

*Attest:*

BRUCE LEHMAN

*Attesting Officer*

*Commissioner of Patents and Trademarks*